United States Patent [19]

Rémond

[11] 3,938,414

[45] Feb. 17, 1976

[54] SCISSOR-TYPE SHEAR FOR LOOM

[75] Inventor: Pierre Rémond, Bourgoin-Jallieu, France

[73] Assignee: Saurer-Diederichs S.A., Bourgoin-Jallieu, France

[22] Filed: Mar. 27, 1975

[21] Appl. No.: 562,857

[52] U.S. Cl. ..... 83/368; 83/559; 83/925 CC

[51] Int. Cl.[2] ..... B26D 5/00

[58] Field of Search ..... 83/368, 440, 440.1, 449, 83/559, 560, 694, 925 CC

[56] References Cited

UNITED STATES PATENTS 1,025,931 5/1912 Steber ..... 83/368

FOREIGN PATENTS OR APPLICATIONS 203,964 6/1959 Austria ..... 83/559

*Primary Examiner*—Willie G. Abercrombie

*Attorney, Agent, or Firm*—Karl F. Ross; Herbert Dubno

[57] ABSTRACT

A support freely pivotal about a fixed vertical axis carries a fixed blade. A lever pivoted on this support carries a pivotal blade crossing the fixed blade. One end of this lever is connected via a spring to the support so as to pivot this lever in one direction and the other end of the lever carries a barrel-shaped roller engageable with the lobes of a continuously rotating cam which open and close the blades. A pair of guides to either side of the blade ride against respective warp filaments between which a cut is to be made so that these warp filaments pivot the entire support about its vertical axis as the blades are continuously and rapidly opened and closed to cut the fabric exactly between these two warp filaments.

10 Claims, 6 Drawing Figures

SCISSOR-TYPE SHEAR FOR LOOM

FIELD OF THE INVENTION

The present invention relates to a fabric-cutting apparatus for a loom. More particularly this invention relates to automatic scissors-type shear for subdividing a fabric along the length of its warp.

BACKGROUND OF THE INVENTION

A fabric is often produced on a loom having a width substantially greater than that which is desired in the finished goods. Frequently also the fabric is produced with a so-called false selvage which must be severed in the direction of the fabric warp from the fabric after weaving thereof. It is also known to deliberately drop several warp filaments and subsequently to transversely subdivide the fabric in the gap in the warp created by these dropped filaments.

Since the fabric normally advances at a relatively rapid rate from the preceding weaving, dyeing, or similar arrangement it is necessary to provide a fast-acting automatic shear to cut the advancing fabric along the desired warp line. In one known device an automatic cutter is provided which has a feeler that rides against the extreme outer edge of the fabric, with the blade or blades of the cutter spaced at a predetermined fixed interval from this outer edge. Although such a device is considerably more accurate than a simple fixed cutter, nonetheless minor variations in fabric width, often caused by unavoidable changes in weft tension or beating-up force allow a cut to be made which does not lie at a fixed distance from a given weft element so that an irregular fringe is produced. In such an arrangement it is also frequently very difficult to adjust the position of the cutter.

OBJECTS OF THE INVENTION

It is therefore an object of the present invention to provide an improved fabric cutter.

Yet another object is the provision of an improved scissor-type automatic shear for cutting a fabric in the direction of its warp as it is continuously advanced in this direction.

A further object is to provide a cutter or shear which can readily be adjusted automatically to track between a given pair of warp filaments.

SUMMARY OF THE INVENTION

These objects are attained according to the present invention in a device for cutting a fabric lengthwise between a pair of warp filaments as it advances continuously. This device comprises a support which carries a first blade and is pivotal about a vertical pivot axis. Guide means is provided including at least one feeler engageable with at least one of the warp filaments between which the cut is to be made for pivoting the support about the axis and thereby positioning the blade between the filaments. A second blade is pivoted on the support and means is provided for oscillating the second blade relative to the first blade for shearing the advancing fabric between the pair of filaments.

According to another feature of this invention the support is provided with a generally vertically oriented lever carrying the second blade and pivoted on the support about a horizontal axis. Between the upper end of the lever and the support there is provided a tension spring which urges the two blades of the shear together, and the bottom end of this lever carries a barrel-shaped roller having the shape of an ellipsoid of revolution with truncated ends. A continuously rotating cam has at least one lobe which on each revolution of the cam engages this roller and opens the shear.

According to yet another feature of this invention there is provided on the support an adjustable abutment against which the lever lies when out of engagement with the cam. This abutment is so positioned that the roller on the other end of the lever lies out of contact with the cam except when engaged by the lobe therof. Thus there is very little resistance to lateral displacement of the support and exact alignment between the pair of warp filaments between which the cut is to be made.

According to yet another feature of this invention the guide means is provided with a pair of feelers each constituted as a bent wire. One end of each wire is clamped on the support and the other end lies to a respective side of the blade and is positioned to run along a respective warp filament. These feeler ends adjacent the blades lie slightly downstream of the cutting portion of these blades. The clamp that secures the feelers to the support is adjustable so as to allow positioning of their ends at different spacings.

The cutting device according to the present invention therefore allows the blades exactly to track along the line between a given pair of warp filaments. In this manner it is possible to cut the fabric exactly between these filaments, even when the lateral or weftwise spacing of these two filaments varies somewhat.

BRIEF DESCRIPTION OF THE DRAWING

The above and other objects, features, and advantages will become more readily apparent from the following, reference being made to the accompanying drawing, in which.

SPECIFIC DESCRIPTION

Figure 1:
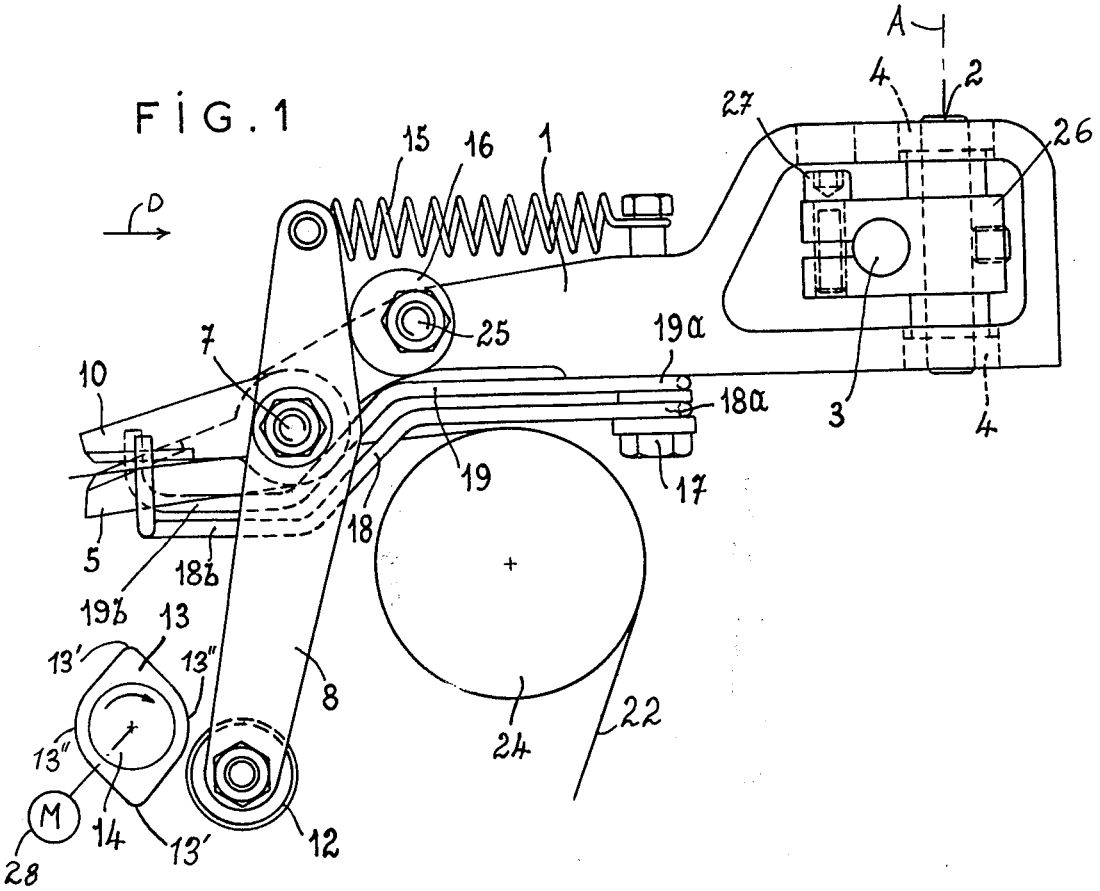
FIG. 1 is a side elevational view of the apparatus according to the present invention.
Figure 2:
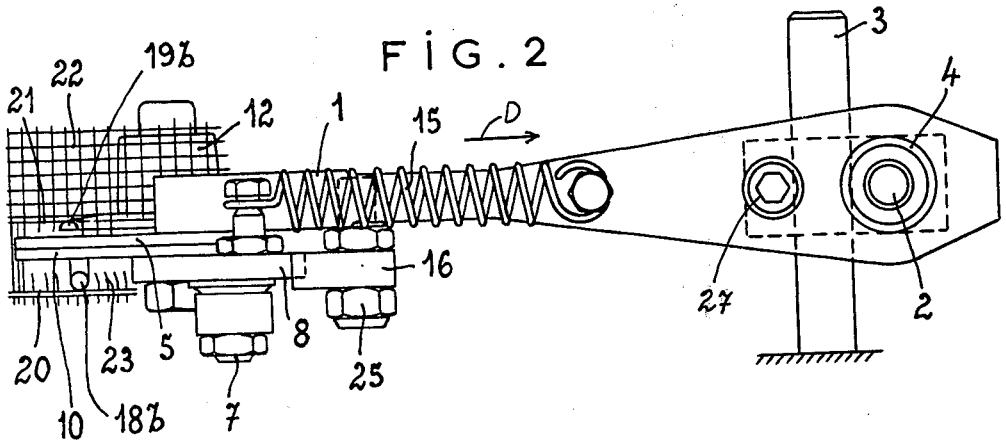
FIG. 2 is a top view of the apparatus of FIG.1.

As shown in FIGS. 1 and 2 the apparatus according to the present invention comprises a support 1 pivotal in ball bearings 4 about a vertical axis A defined by a pin 2 fixed in a block 26 secured by means of an Allen screw 27 on a fixed horizontal mounting shaft 3. Thus this horizontally elongated support 1 can swing about the vertical axis A and can be positioned anywhere along the rod 3.

Figure 3:
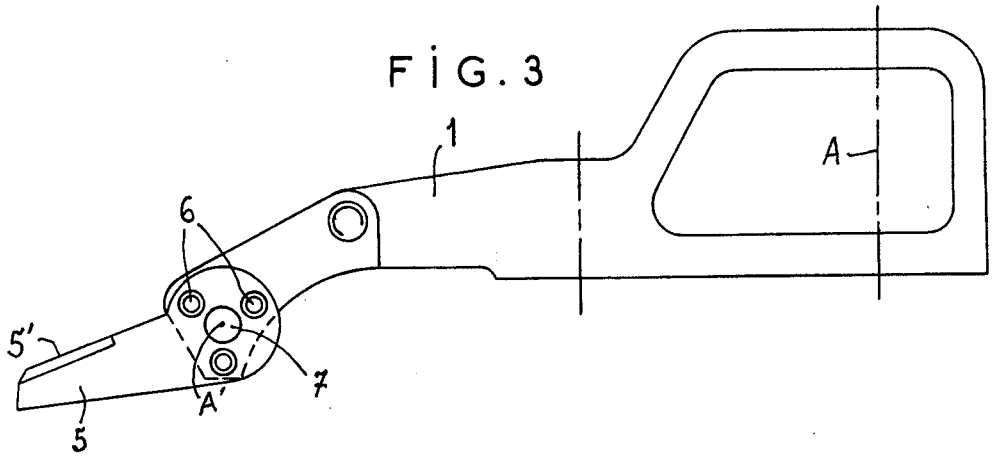
FIG. 3 is a side elevation view of the support of the apparatus of FIG. 1.
Figure 4:
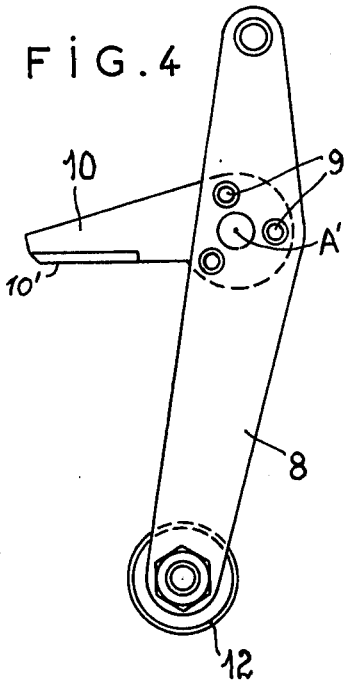
FIG. 4 is a side elevational view of the lever and movable blade of the apparatus of FIG.1.
Figure 5:
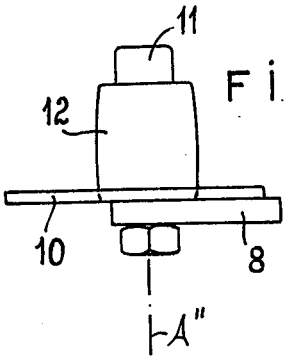
FIG. 5 is a top view of the lower end of the actuating lever of the apparatus.
Figure 6:
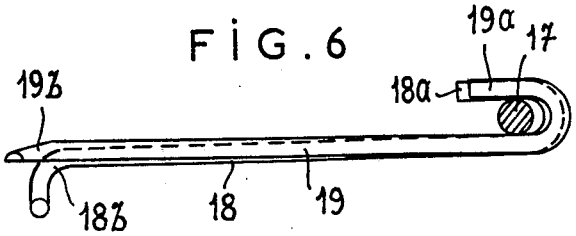
FIG. 6 is a top view partly in section illustrating the feelers of the apparatus.

On its outer end the support 1, as also shown in FIG. 3, is provided with blade 5 having a cutting edge 5'. Rivets 6 secure the blade 5 to the support 1 with the edge 5' inclined to the horizontal An axle pin 7 pivotally carries a lever 8 to which is secured another blade 10 by means of three rivets 9. These rivets 9, like the rivets 6, are angularly equispaced about an axis A' perpendicular to the axis A and defined by the axle pin 7. The blade 10 has a cutting edge 10' which normally lies horizontal and across the edge 5'. At its lower end the lever arm 8 is provided with a pivot pin 11 defining an axis A'' parallel to the axis A' and carrying a barrel-shaped roller 12. A motor 28 continuously rotates a shaft 14 carrying a two-lobe cam 13. The lobes 13' of this cam are engageable with the roller 12, but the lands 13'' between these lobes 13' are normally engaged with the roller 12. This is effected by an abutment constituted by an eccentric disk 16 secured by means of a tightenable screw 25 to the support and engageable with the upper end of the lever 8. A tension spring 15 is connected between the support and the upper end of the lever 8 to normally urge the upper end of the lever 8 back against the abutment 16, thereby bringing the roller 12 as close as possisble to the cam 13. Thus rotation of the cam periodically pivots the lever 18 against the force of the spring 15 and thereby oscillates the edge 10' across the edge 5'.

A roller 24 draws a web, here a fabric 22 having a pair of spaced-apart web filaments 20 and 21, through the apparatus, with that stretch of the web 22 downstream down of the blades 5 and 10 being pulled into the mouth between these blades 5 and 10.

The support is further provided with clamping nuts 16 into which hook-shaped end **18*a* and 19*a* of a pair of feeler wires 18 and 19 are secured. The other ends 18*b* and 19*b* of these wires 18 and 19 are bent to extend vertically upwardly and lie on opposite sides of the blades slightly downstream of the location at which the edges 5' and 10' normally cross. The end 19*b* which is shaped so as to be semicircular in section, therefore rides against the weft filament 21, and the round end 18*b* of the wire 18 rides against the filament 20. This causes a fringe 23 to be produced which is always of identical length, as the guides 18 and 19 cause the support 1 to pivot about its axis A, keeping the blades 5 and 10 exactly aligned between the warp filaments 20 and 21.**

The support 1 pivots very easily about the axis A because of the bearings 4, and also because the roller 12 only periodically engages the lobes 13'. Thus very little force need be exerted against the ends **18*b* and 19*b* in order to pivot the support 1 and perfectly align the blades 5 and 10 between the filaments 20 and 21.**

I claim:

1. A device for cutting a fabric lengthwise between a pair of warp filaments as it is advanced continuously, said device comprising:

a support carrying a first blade;

a pivot defining a vertical pivot axis for said support;

guide means including at least one feeler engageable with at least one of said pair of warp filaments for pivoting said support about said axis and thereby positioning said blade between said filaments;

a second blade pivoted on said support; and means for oscillating said second blade relative to said first blade for shearing said fabric between said pair of filaments.

2. The device defined in claim 1 wherein said guide means includes a pair of such feelers flanking said blades and each engageable with a respective one of said pair of warp filaments.

3. The device defined in claim 2, further comprising a lever pivoted on said support about a blade axis generally orthogonal to the support axis and carrying said blade, said means for oscillating including a cam engageable with an end of said lever.

4. The device degined in claim 3, further comprising holding means for positioning said feelers and locking same in place in areas to the side of and downstream of said blades relative to the direction of fabric advance.

5. The device degined in claim 4 wherein said feelers are constituted of bent wires each having a feeler end positioned adjacent said blades and an attachment end fixed to said support by said means for positioning.

6. The device defined in claim 3 wherein said end of said lever is provided with an elongated roller engageable with said cam and rotatable about an axis generally parallel to said blade axis.

7. The device defined in claim 6, further comprising a spring connected between said lever and said support and stressed to urge said end of said lever toward said cam, and an adjustable abutment on said support engageable with said lever, said spring urging said lever toward said abutment, said abutment being positionable so that said end of said lever is engageable with said cam on rotation thereof.

8. The device in claim 7 wherein said adjustable abutment includes a tightenable screw and an eccentric element securable by said screw to said support and engageable with said lever.

9. The device defined in claim 8 wherein said cam has at least one lobe and is rotatable, whereby said lobe periodically engages said roller.

10. The device defined in claim 7 wherein said lever is generally vertical and said second blade extends from said lever at said blade axis generally horizontally.

* * * * *